US005226734A

United States Patent [19]

Scott et al.

[11] Patent Number: 5,226,734

[45] Date of Patent: Jul. 13, 1993

[54] HANGER BAG ASSEMBLY

[76] Inventors: Ida S. Scott, 5230 N. Capital St., NW., Washington, D.C. 20011; Pandora A. Reese, 8052 Montague Ct., Glen Burnie, Md. 21061

[21] Appl. No.: 661,193

[22] Filed: Feb. 27, 1991

[51] Int. Cl.[5] ..... B65D 33/14

[52] U.S. Cl. ..... 383/22; 383/63; 383/120; 312/184; 40/359

[58] Field of Search ..... 383/22, 23, 66, 63, 383/84, 86, 120; 229/68 C, 15 R; 248/95; 40/359; 312/184

[56] References Cited

U.S. PATENT DOCUMENTS

| | | | |
|---|---|---|---|
| 2,357,070 | 8/1944 | Bates | 40/359 |
| 2,886,085 | 5/1959 | Sanger | 383/120 |
| 3,664,051 | 5/1972 | Benichou | 40/359 |
| 3,885,726 | 5/1975 | Fridlund et al. | 229/1.5 R |
| 4,186,504 | 2/1980 | Avery | 40/359 |
| 4,209,925 | 7/1980 | Briigmann | 40/359 |
| 4,749,121 | 6/1986 | Barber et al. | 229/1.5 R |
| 4,790,474 | 12/1988 | Mitsuyama | 229/1.5 R |
| 4,793,495 | 12/1988 | Preu | 312/184 X |
| 4,909,397 | 3/1990 | Huber | 312/184 X |

FOREIGN PATENT DOCUMENTS

| | | | |
|---|---|---|---|
| 1189951 | 4/1965 | Fed. Rep. of Germany | 312/184 |
| 729541 | 7/1932 | France | 312/184 |
| 1093100 | 4/1955 | France | 312/184 |
| 2377284 | 9/1978 | France | 312/184 |
| 2534530 | 4/1984 | France | 312/184 |
| 911352 | 11/1962 | United Kingdom | 312/184 |
| 2184997 | 7/1987 | United Kingdom | 383/63 |
| 8906601 | 7/1989 | World Int. Prop. O. | 40/359 |

*Primary Examiner*—Allan N. Shoap
*Assistant Examiner*—Jes F. Pascua
*Attorney, Agent, or Firm*—Larson and Taylor

[57] ABSTRACT

A hanger bag assembly comprises an elongate hanger rod including notches at opposite ends thereof for engaging a pair of parallel support rails such as those of a filing cabinet so that the hanger rod is supported by the rails, and a bag affixed to the hanger rod and adapted to be suspended therefrom when the hanger rod is supported on the support rails. The bag includes a closure device (e.g., a rib and groove closure arrangement or a zipper) which extends across the width of the bag and is spaced below the hanger rod, and which, when closed, provides full enclosure of the contents of the bag within the bag volume. In an important embodiment, the closure device is spaced a substantial distance below the hanger rod so as to relieve the effect thereon of any bag opening forces exerted at the top of the bag by the contents of the bag (e.g., a coiled guide wire). An elongate downwardly opening clip of inverted U-shape in cross section is affixed over the hanger member at the top of the bag, and the clip is color-coded so as to identify the contents of the bag. An identification element, e.g., a holder for an identification card, is affixed to the elongate clip so as to slide therealong.

8 Claims, 2 Drawing Sheets

HANGER BAG ASSEMBLY

FIELD OF THE INVENTION

The present invention relates to closeable storage devices such as storage bags, pouches and receptacles and, more particularly, to an improved storage device which permits suspension thereof from parallel support rails such as are provided in the drawers of filing cabinets and the like.

BACKGROUND OF THE INVENTION

The storage of medical supplies in a hospital or other facility presents a number of problems. For example, the sheer number of different items places a considerable strain on the normally limited amount of space available. Further, many items must be stored in a manner which preserves their sterility so that specialized packaging is required. In addition, it is very important that the items be readily accessible in that the immediate availability of an item can sometimes literally be the difference between life and death while even in a more routine situation, a storage arrangement which enables systematic cataloging of the stored items and provides easy and ready access thereto can substantially increase the efficiency of a supply section or branch of a hospital or the like. Further, some medical items present specialized problems such as the long guide wires used in endoscopy because they exert forces which tend to cause unwanted opening of the package or bag in which they are contained.

As discussed below, the present invention is concerned with the provision of a storage receptacle or bag which is of the type including a closure for sealing or other protecting the contents thereof from dust and dirt and which is adapted to be hung from a pair of support rails such as those of a filing cabinet. Of course, hanging folders for filing cabinets are quite common and examples of patents relating to such hanging file folders include U.S. Pat. Nos. 4,475,657 (Albery); 3,684,340 (Kirkorian); 2,329,201 (Jonas); and 2,325,317 (Hanna). Other patents or possible interest insofar as the present invention is concerned include U.S. Pat. No. 4,730,736 (Lindquist et al) which discloses a hanger strip for envelopes containing flat articles; U.S. Pat. No. 1,217,243 (Tucker et al) which discloses a map storage system wherein a suspension rod for hanging maps is provided with index slips arranged so as to enable one to rapidly sort through the hanging maps; U.S. Pat. No. 4,590,610 (Rhyne) which discloses a hanging product display package wherein a garment bag or the like is suspended from a rigid plastic "coathanger," and U.S. Pat. No. 492,163 (Ives) which discloses a hanger arrangement for moth-proof bags. Further, U.S. Pat. No. 4,848,928 (Ausnit) discloses a package with a "ZIPLOC" closure provided at a location intermediate edges thereof.

SUMMARY OF THE INVENTION

As mentioned above, in accordance with the present invention, a storage assembly is provided which comprises a support or hanger member having hooks, notches or the like at the opposite ends thereof for engaging spaced parallel support rails and a closeable storage bag suspended from the support member, the storage bag including closure means which, when opened, permits access to the contents of the bag and which, when closed, seals off these contents. Thus, as is discussed in more detail hereinbelow, the invention enables storage of items which cannot be practically stored using a hanging folder while enabling these items to be stored in an efficient, systematic manner. The bag is suspended at the top edge thereof from the support member and the closure means is disposed intermediate the top and bottom edges of the bag so as to be spaced from the top edge.

In one preferred embodiment an interlocking rib and groove closure (such as that found on "ZIPLOC" bags) is used which extends across the width of the bag while in another preferred embodiment a zipper type closure is employed. In the former embodiment, gripping tabs are advantageously provided on the two closure elements forming the closure to facilitate opening of the closure. The spacing of these closures from the top edge of the bag prevents the bag from being forced open as might occur, for example, where a coil of a springy material (such as the coiled guide wire referred to above) is stored in the bag since such articles generally attempt to uncoil when stored in a coiled state and thus would normally tend to force open a closure provided at the mouth of a bag. In yet another embodiment not applicable to the storage of such items, a flap-like closure similar to that of an envelope is provided near the top of the bag.

In a preferred embodiment, the bag is affixed to the hanger member intermediate ends of the hanger member with the assistance of an elongate clip having a cross sectional shape corresponding to that of an inverted U, with the arms of the U being biased towards one another so as to exert a holding force for holding the clip in place. The holding clips, which are preferably made of plastic or the like, are advantageously color coded so that a user (e.g., a nurse in medical supply unit) can readily determine which item or articles (or group of items or articles) is being stored within a bag simply by noting the color coding.

In addition, or alternatively, an identification or indexing element or attachment is provided which, in a preferred embodiment, is affixed to and can slide along the retaining clip and, to this end, the identification element includes at the bottom edge thereof inwardly and upwardly directed retaining portions which fit around and inside of the bottom edges of the downwardly depending arms of the retaining clip. The identification element can contain or carry identifying information itself or can receive a card or the like containing such information.

The bag, which is preferably made of transparent or semitransparent plastic to permit viewing of the contents thereof, preferably includes pleats or gussets which enable the bag to expand to accommodate larger items.

As is explained in more detail below, although the focus of much of the discussion here is on medical supply applications, the invention is wide of applicability and usefulness.

Other features and advantages of the invention will be set forth in, or apparent from, the following detailed description of preferred embodiments of the invention.

DESCRIPTION OF THE PREFERRED EMBODIMENTS

Figure 1:
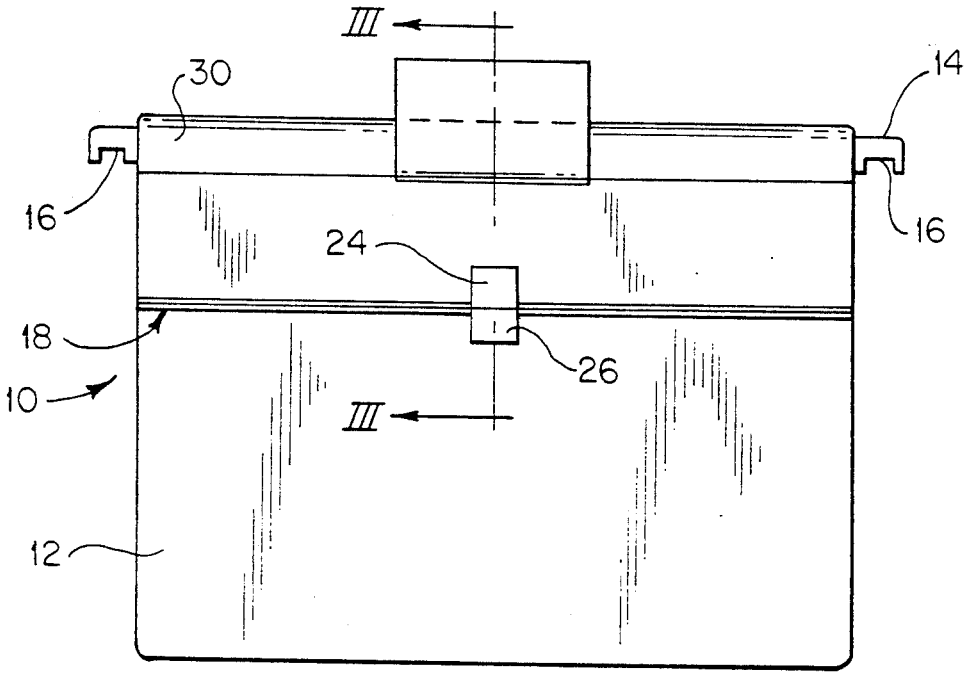
FIG. 1 is a front elevational view of a hanger bag assembly constructed in accordance with a first preferred embodiment of the invention.
Figure 2:
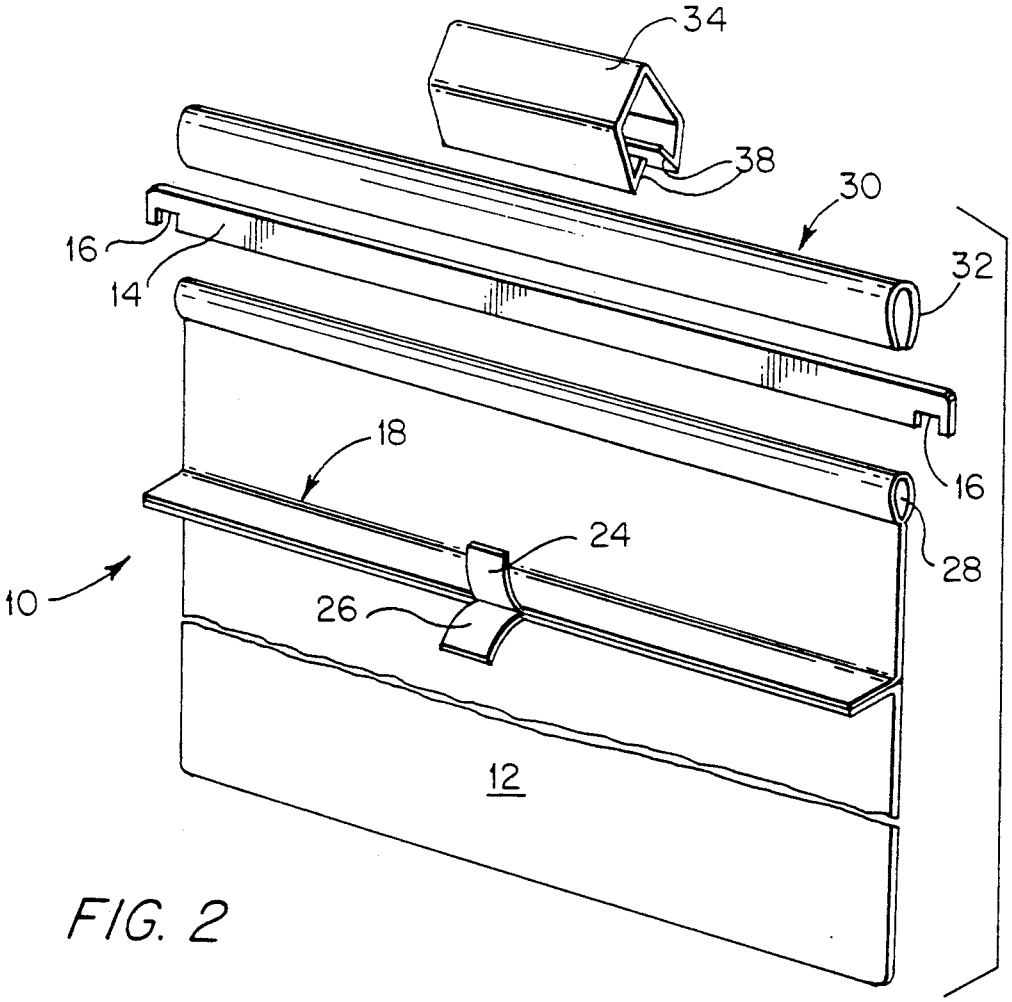
FIG. 2 is an exploded perspective view of the assembly of FIG. 1.

Referring to FIGS. 1 and 2, there is shown a hanger bag assembly constructed in accordance with a first preferred embodiment of the invention. The hanger bag assembly, which is generally denoted 10, includes a bag or receptacle 12 preferably made of plastic or a material which is transparent or semi-transparent so as to permit viewing of the contents thereof. The bag 12 is affixed to an elongate hanger rod 14 having notches or recesses 16 at the two ends thereof that form hooks so as to permit the hanger rod 14, and thus the bag 12 suspended therefrom, to be supported on the parallel rails of a file cabinet as is discussed in more detail below in connected with FIG. 4.

Figure 3:
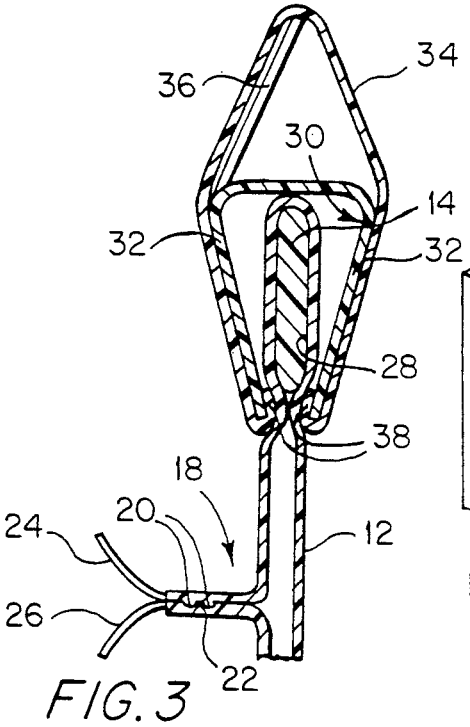
FIG. 3 is a cross sectional view, drawn to an enlarged scale and taken generally along line III—III of FIG. 1.

In this embodiment, bag 14 includes a closure element 18 of a conventional interlocking rib and groove type which, as illustrated in FIG. 3 includes parallel ribs 20 formed on an upper edge portion of closure element 18 so as to define a groove therebetween 20 and a rib 22 formed o a lower edge portion of closure element 18 and adapted to be received as a snap fit in that groove, all in a conventional manner. Finger tabs 24 and 26 provided on the edges of the end portions of closure element 18 so as to enhance gripping of these end portions when opening of the closure element 18.

Bag 12 can be attached or affixed to hanger rod 14 in a number of different ways and in the illustrated embodiment an elongate slot or opening 28 is provided which extends along the top edge of bag 12 and in which rod 14 is received.

As perhaps can best be seen in FIG. 3, a clip member or holding clip 30 of an inverted U shape in cross section fits over the top of bag 12 and rod 14, and with the opposing arms 32 of clip 30 being biased towards each other so as to hold clip 30 in place. Each clip 30 is color coded so as to provide ready identification of the contents of the associated bag 12 so that, for example, all similar items or all items of the same group or classification (e.g., all types of rubber tubing) would be provided with a clip 30 of the same color. This enables similar items to be readily grouped together without the need for reading labels, etc.

To further refine the classification of the contents of a bag 12, an identification or indexing element 34 is also provided which fits over clip 30 and which is adapted to carry, on the face of element 34, further information with respect to the contents of the associated bag 12 or to receive an identification card, denoted 36 on FIG. 3, carrying such information. In the latter implementation which enables a standard identification element 34 to be used for each hanger assembly by simply varying the identification card 36, identification element 34 is preferably constructed of clear plastic to permit viewing of card 36. Element 34, which is generally in the shape of an inverted V, preferably includes holding flaps or tabs 38 which, as illustrated in FIG. 3, extend along the lower edges thereof and which fit under the lower edges of clip 30 so as to secure element 34 in place on clip 30. This arrangement permits element 34 to be varied in position by sliding the same along clip 30 to a desired location.

Figure 4:
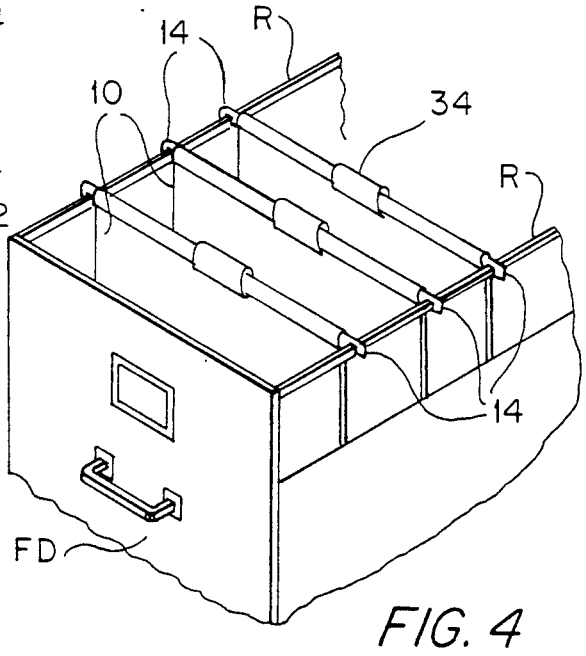
FIG. 4 is a schematic perspective view of a filing drawer in which are suspended a plurality of hanger bag assemblies in accordance with the invention.

Referring to FIG. 4, an example of the manner of usage of the hanger bag assembly of the invention is illustrated. More specifically, three (or more) of the assemblies 10 are mounted by means of the notches 16 in hanger rods 14 on parallel rails R provided within a file drawer FD. Thus, the assemblies 10 can be hung in the manner of conventional file folders while providing sealed but readily accessible storage of the contents of bags 10.

Figure 5:
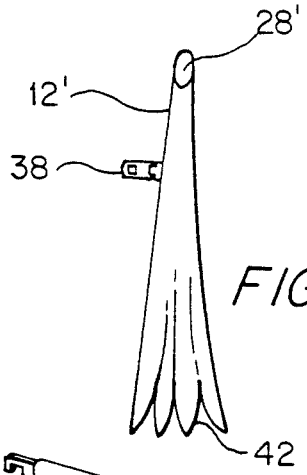
FIGS. 5 and 6 are side and front elevational views, respectively, of a different embodiment of a bag for use with the hanger bag assembly of the invention.
Figure 6:
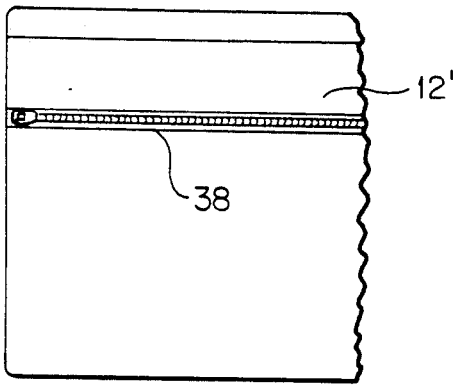

Referring to FIGS. 5 and 6, a further embodiment of the bag used in the bag hanger assembly of the invention is shown. This embodiment is similar to that described above and like parts or elements have been given the same reference numerals with primes attached. In this embodiment, the closure 18' comprises a conventional plastic zipper 40 or like zipper-type closure, and pleats 42 are provided in the bottom of the bag 12' to enable the volume of the bag to be expanded so as to accommodate relatively large sized items. It will be understood that gussets or other techniques for expanding the bag volume could also be used.

Figure 7:
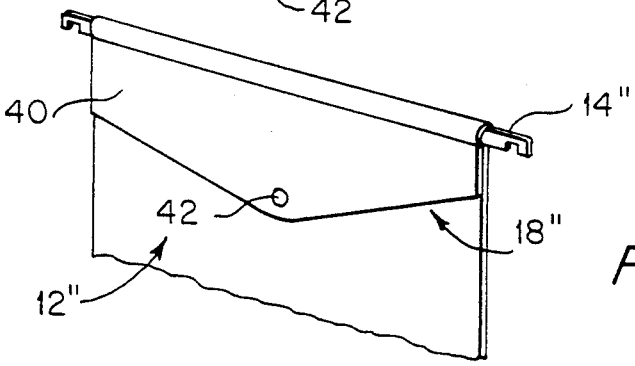
FIG. 7 is a perspective view, partially broken away, of yet another embodiment of the invention.

Referring to FIG. 7, yet another embodiment of the invention is shown. This embodiment is also similar to that described above and like parts or elements have been given the same reference numerals with double primes attached. In this embodiment, a closure 18" is provided which is located nearer the top of bag 12" and which comprises an envelope-type cover flap 40 adapted to be closed by a snap fastener 42. Other types of closures for flap 40 can also be used such as a resealable glue, a hooks and loops closure, and the like as well as the closures discussed previously (e.g. zippers). While the closure element 18" illustrated in FIG. 7 would be disadvantageous for applications such as the storage of coiled wire, it is quite acceptable for other applications such as some of those discussed below.

Although the invention has been described above in relation to the storage of medical articles and equipment of various kinds, it is to be understood that the invention is applicable to many other fields. For example, the invention would be very useful in police and legal work wherein the hanger bag assembly of the invention could be used to file exhibits or other evidence or, in a jail setting, to temporarily store the personal belongings of individuals awaiting disposition of their cases. Similarly, the hanger bag assembly can be used to store the personal belongings of hospital out-patients while service is being provided to those patients. The invention could also be used to store children's toys, e.g., in decorated cabinet in a child's room. Other home uses include the storage of sewing equipment, patterns, crafts, coupons and the like as well as to provide secure storage of important papers such as insurance policies, warranties, wills, family records and the like. Further, secretaries can use the invention to conveniently store supplies such as pencils, pens, white-out, staples an the like. In general, the invention can be used as part of an organizational system in any area where items are to be kept and stored.

Finally, while the invention has been described above with respect to a recloseable bag, it should be understood that a completely sealed bag, e.g., a sterile bag which is heat sealed around the edges thereof (and which is destroyed when opened), could also be used.

Although the present invention has been described relative to specific exemplary embodiments thereof, it will be understood by those skilled in the art that variations and modifications can be effected in these exemplary embodiments without departing from the scope and spirit of the invention.

What is claimed is:

1. A hanger bag assembly comprising an elongate hanger rod including notches at opposite ends thereof for engaging a pair of parallel support rails so that the hanger rod is supported by parallel support rails engaged thereby, and a bag comprising a top, sides, and a bottom, and front and back portions defining a volume therebetween, said bag including at the top thereof a continuous sleeve extending across the width of the bag and having front and back portions contiguous with, and extending upwardly from, the front and back portions of the bag, said sleeve defining an elongate continuous opening extending across the width of the bag, and said hanger rod extending completely through said opening, being telescopingly received in and slidably removable from said opening, and projecting outwardly from opposite sides of said opening so that when the hanger rod is supported by parallel support rails said bag is suspended from said hanger rod, said bag being adapted to hold contents, being sealed at the sides and bottom and including an openable bag closure means, extending across at least a major part of the width of the bag and spaced below said hanger rod, for, when closed, providing sealed enclosure of the contents of the bag on all sides thereof within the bag volume, said notches at the opposite ends of said hanger rod extending outwardly from said sleeve on opposite side thereof beyond the sides of the bag, and said bag further including pleat means for, when expanded, enlarging the volume of the bag, said pleat means including pleats formed in said bag.

2. An assembly as claimed in claim 1 wherein said closure means is spaced a substantial distance below said hanger rod so as to relieve the effect thereon of any bag opening forces exerted at the top of the bag by contents within the bag.

3. An assembly as claimed in claim 1 further comprising an elongate downwardly opening clip of inverted U-shape in cross section affixed over and substantially along the length of the said hanger rod at the top of the bag.

4. An assembly as claimed in claim 3 wherein said clip is of a predetermined color so as to identify the contents of the bag based on a color code which identifies different contents by different colors.

5. An assembly as claimed in claim 4 further comprising an identification element affixed to said elongate clip.

6. An assembly as claimed in claim 5 wherein said elongate clip includes lower edges and said identification element comprises upturned holding flaps at the lower edges thereof which extend around the lower edges of said elongate clip.

7. As assembly as claimed in claim 1 further comprising an identification element affixed to the top of the bag for identifying the contents of the bag.

8. A hanger bag assembly as claimed in claim 1, wherein said bag closure means comprises an interlocking rib and groove arrangement.

* * * * *